US005347677A

United States Patent [19]

Prentice

[11] Patent Number: 5,347,677

[45] Date of Patent: Sep. 20, 1994

[54] APPARATUS FOR CLEANING ISOLATED SURFACES

[76] Inventor: William H. Prentice, 1028 Jeannette St., Des Plaines, Ill. 60016

[21] Appl. No.: 16,977

[22] Filed: Feb. 12, 1993

[51] Int. Cl.[5] ..... F23J 3/02

[52] U.S. Cl. ..... 15/318; 15/345; 15/315; 15/353; 15/395; 15/406

[58] Field of Search ..... 15/345, 315, 318, 353, 15/395, 405, 406, 408

[56] References Cited

U.S. PATENT DOCUMENTS

| | | | |
|---|---|---|---|
| 2,982,971 | 5/1961 | Garaway | 15/406 |
| 3,074,098 | 1/1963 | Downing | 15/406 |
| 3,897,605 | 8/1975 | Dickinson | 15/405 |
| 4,505,001 | 3/1985 | Fasolino | 15/405 |
| 4,718,142 | 1/1988 | Wahlers | 15/395 |
| 4,792,363 | 12/1988 | Franklin, Jr. et al. | 15/395 |
| 5,074,337 | 12/1991 | Shaw et al. | 15/345 |
| 5,107,568 | 4/1992 | Wade | 15/395 |
| 5,109,567 | 5/1992 | Harrison | 15/345 |

*Primary Examiner*—Timothy F. Simone
*Assistant Examiner*—James F. Hook
*Attorney, Agent, or Firm*—Wood, Phillips, VanSanten, Hoffman & Ertel

[57] ABSTRACT

A cleaning apparatus as for inside surfaces in residential air ducts, employing a baffle that locally increases air velocity at the surface of the duct to the entrainment velocity that will remove dust and detritus with the help of reaction driven scouring elements for the mechanical dislodgement of dirt and dust. The dirt and dust can then be carried to a collection point by an induced flow of air through the duct. The invention also contemplates a method of cleaning a duct utilizing the above apparatus.

19 Claims, 4 Drawing Sheets

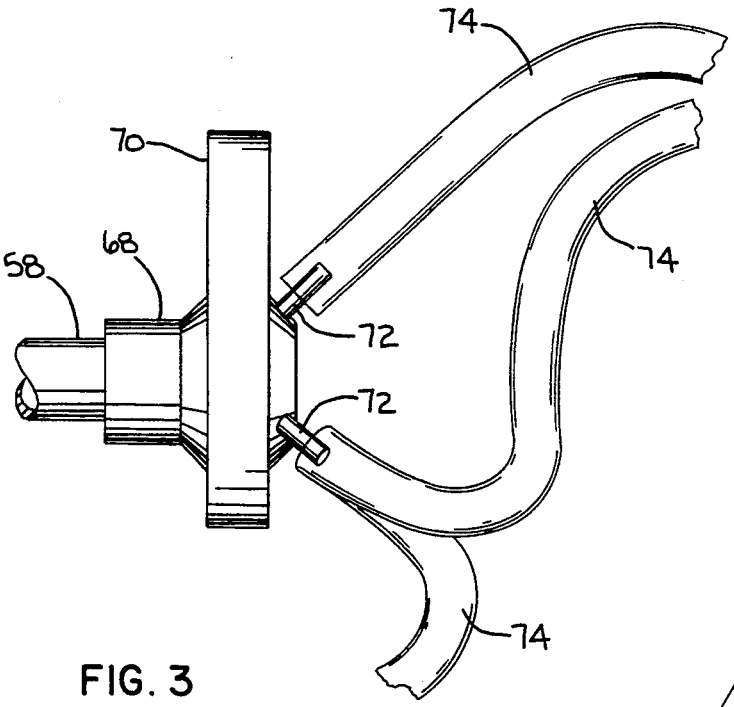
FIG. 3
FIG. 4
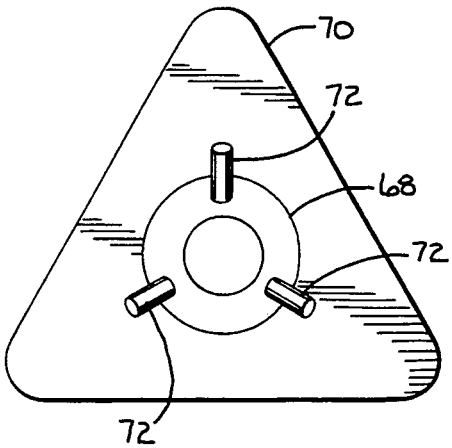
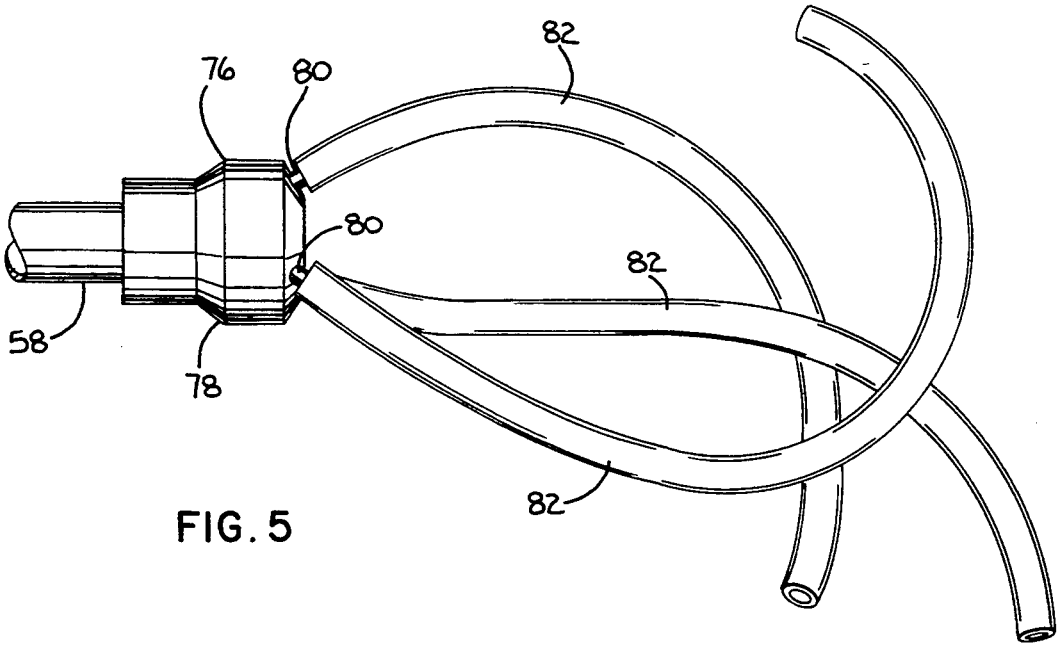
FIG. 5

APPARATUS FOR CLEANING ISOLATED SURFACES

BACKGROUND OF THE INVENTION

1. Field Of the Invention

The present invention is directed to an apparatus for removing dust, dirt, and debris from the interior of air handling ducts and similar confined areas, difficult to reach with currently available cleaning devices or systems.

2. Background Art

Because the interior of air handling ducts is not an obvious extension of the rooms of a dwelling or the work-place of a factory, business office or the like, these isolated areas are often given little attention in cleaning operations. Intensive effort is customarily made to keep living areas and working areas clean while ignoring the interior of the heating and ventilating systems. Lack of awareness of ducts as part of the living/working area is partly to blame for much of the general indifference to the cleanliness of duct systems.

Additionally, most of the cleaning systems and methods now in use are little better than those used at the turn of the century.

The broad attention being given to clean air in our society is giving strong impetus to the growth of residential and commercial duct cleanliness. Many physicians are making air duct cleanliness a feature in the treatment of their patients, specifically those with asthma. Most of the presently available duct cleaning methods are rated unsatisfactory by medical people, who must recommend them, and these medical people also have difficulty accepting the effectiveness of the best methods/systems now on the market.

Many businesses and authorities associated with duct cleaning judge the effectiveness of equipment available for this type of work by the volume of air flow in cubic feet per minute (hereinafter to be referred to as volume or air volume) that a large suction fan is capable of inducing in the duct system during the cleaning operation, whereas the proper criterion should be air velocity at the interior surface of the duct stated as feet per minute that would lift and entrain particulate matter from interior surfaces, hereinafter to be referred to as "air entrainment velocity". This air entrainment velocity is specific for different materials and it is this parameter that should be the parameter of choice used to measure and judge the effectiveness of the present invention and similar cleaning devices or systems. If the suction fan that induces air flow through the duct system being cleaned were to be sized to attain air entrainment velocity in the largest portion of duct in the system, the fan size would be inordinately large and impractical. Some examples from engineering handbooks of the entrainment velocities required for different materials are:

| | |
|---|---|
| Ashes, powdered | 6500–8500 fpm |
| Cement | 6500–9000 fpm |
| Coal, powdered | 4000–5500 fpm |
| Cotton | 4500–6500 fpm |
| Flour | 3500–6500 fpm |
| Grain Dust | 2000–3000 fpm |

It can be shown, by calculation, that the volume (cfm) of air required to provide the entrainment velocity for detritus in a duct measuring 1 ft. by 1 ft., with air moving at a velocity of 5000 ft./min., would be inadequate for another section of duct in the same system measuring 2 ft. by 2 ft. since the air velocity in the larger duct would drop below the entrainment velocity. Since air ducts vary in size by design, it is therefore, logical that air entrainment velocity and not volume of air moving through the duct should be the prime criterion for rating such cleaning processes. It should be the goal of the cleaning crew to be certain that entrainment velocity is reached as close as is practical to the surface of the duct in the area being cleaned, as the cleaning operation progresses through the duct. The entrainment velocity for material varies with the size, specific gravity and the shape of the material as follows:

$$V-(6{,}000)(s)(d0.40)/(s+1)$$

in which,

V=Velocity, ft/min s=Specific Gravity of particles.

d=Avg. dia. of particles, inches

Normal, laminar airflow in ducts is known to move predominately through the center of the duct in "plug flow" with air velocity, as measured across a section of the duct, being progressively slower as the interior of the duct surfaces is approached. Immediately at the interior surface of the duct the air film moves so slowly that for practical purposes it produces a boundary layer of air that can be considered, in the practical sense, to be quiescent; a condition that permits entrained dust to settle out and cling to the duct surface. Dust collection on the duct surface is less along the interior top surface of the duct and more pronounced along the bottom interior surface of the duct, the difference due to gravity. Also, the dust deposition is generally electrostatic in nature and, with time, the dust particles consolidate to a degree that air flow alone cannot satisfactorily remove this dust layer. Mechanical disturbance of the dust is requisite to both removal of the dust from the surface and to present it to swiftly moving currents of air so that said dust might be entrained and removed.

At the present state of the art, duct cleaning equipment employs high capacity suction fans set up to exhaust air directly from the household furnace plenum to a dust collecting bag chamber. These low pressure vacuum systems customarily operate at air pressures of around 0.5 psi and are most suitable for the low density material with which we are concerned in duct cleaning. Further, these currently employed systems depend upon air volume alone, as measured at the fan, to do the principal work of dust entrainment and dust transport, with some operators assisting the work of the suction fan with hand operated devices such as brushes or air jets. It has been established that such methods are helpful but inadequate. The velocity induced in the ducts by systems in current use acts only through a sweeping air current and must be assisted by, for example, mechanical devices or air jets, to overcome the quiescent boundary layer at the interior duct surfaces. The effect of this boundary layer can never be eliminated, in the practical sense, by air flow alone. It is then necessary to provide some additional means to increase the velocity of air in the duct in the local area of the cleaning apparatus. Further, since this boundary layer is a formidable barrier, it is necessary to disturb and lift the dirt and dust at the boundary layer in an energetic manner, such that the dust can be efficiently entrained in the air stream.

SUMMARY OF THE INVENTION

In view of the foregoing discussion, a primary object of this invention is to provide a novel and more effective cleaning apparatus and method that can be used to remotely scour and remove dust and debris from the interior surfaces of ducts in such a manner that the dust is easily entrained in the air provided by a suction fan.

Another object of this invention is to provide a positive method for cleaning obscure areas, such as air ducts, not amendable to direct examination for approval to give assurance that a thorough job has been done.

Another object of this invention is to provide a suitable device to interrupt plug flow of air in air ducts, said device hereinafter to be referred to as a "baffle", and force the air around the baffle and through the annular space between the baffle edges and the interior duct surfaces. The baffle could be a variety of shapes ranging from a plate, mounted at 90 degrees to the air flow, to a tear drop shape. The purpose of the baffle is to redirect air flow and accelerate air near the duct surfaces to the entrainment velocity of the material being removed from the duct in the cleaning operation.

Another object of this invention is the provision of an air-distribution manifold affixed to an extendable, semi-rigid rod, hereinafter referred to as a "control rod", or an extendable, semi-rigid, hollow, compressed air conduit, hereinafter referred to as an "air conduit". The air conduit or air distribution manifold have one or more flexible, hollow, beating and scouring elements, each hereinafter to be referred to as a "scouring element", to be affixed to barbs or suitable fitments by one end, with the other end free, in such a manner that compressed air from the manifold passes through the scouring element(s) resulting in a random, sinuous, scouring action as the scouring element(s) reacts to the force of the air discharging from the free end. This assembly of elements, air conduit or control rod, air manifold, barb(s) and scouring element(s), shall hereinafter be referred to as the "cleaning head". The aforesaid scouring element(s) are made from suitable, flexible compositions including but not limited to plastic, rubber, fabric or the like. The wildly energetic and forceful sinuous action induced in the scouring element(s) is analogous to the action of an unattended fire hose or garden hose through which water is flowing at a high rate. This energetic and powerful reaction drives the scouring element(s) into the corners, folds, depressions and over all the interior surfaces of the duct with great force and with a vigorous scouting action that, combined with the effect of the jet of air issuing from the free end of the scouring element(s), effectively raises the dust and debris in the duct so that it can be easily transported by the air flow through the duct system induced by a remote suction fan.

Another object of the present invention is to provide the cleaning head, the baffle or the fitments with sloping edges, rounded surfaces, wheels, skids or the like so that they can easily be maneuvered over obstructions, such as duct seams.

Another object of the present invention is to provide a cleaning apparatus that will effectively clean long ducts by establishing positional control of the cleaning head in duct runs of forty feet or more without requiring the cutting of many large access holes necessary for the introduction of hand held mechanical devices.

Another object of the invention is to provide the cleaning apparatus with a flat baffle plate that materially assists the passage of the cleaning head through the duct by the force of the strong flow of air, provided by a remote suction fan, acting on the baffle plate.

Another object of the present invention is to provide methods for cleaning ducts that do not require the area of the duct being cleaned to be under specific scrutiny to assure cleanliness since simple calculation of entrainment velocities around the edges of the baffle plus the vigorous action of the scouring elements gives the assurance of cleanliness that is a requisite for sections of ducts that cannot be opened for inspection.

Another object of the present invention is to provide additional cleaning action from the blasting action of the air discharging from the ends of the scouring element(s), this additional cleaning action materially aiding in cleaning and dust removal.

Another object of the present invention is to provide the versatility to clean wide ducts by adding additional cleaning heads side by side and to advance them down the duct as one unit.

BRIEF DESCRIPTION OF THE DRAWINGS

These and other objects and features that I believe to be characteristic of my invention are set forth with particularity in the appended claims. The invention, both in organization, manner of construction, and choice of construction materials, together with further objects and advantages thereof may be best understood by reference to the following description taken in connection with the accompanying drawings, in which:

FIG. 3 is an enlarged, side view of another form of a baffle and cleaning head according to the invention;

FIG. 4 is an end view of the cleaning head in FIG. 3;

FIG. 5 is a side elevation view of a modified form of stand-alone cleaning head according to the invention.

DETAILED DESCRIPTION OF THE DRAWINGS

Figure 1:
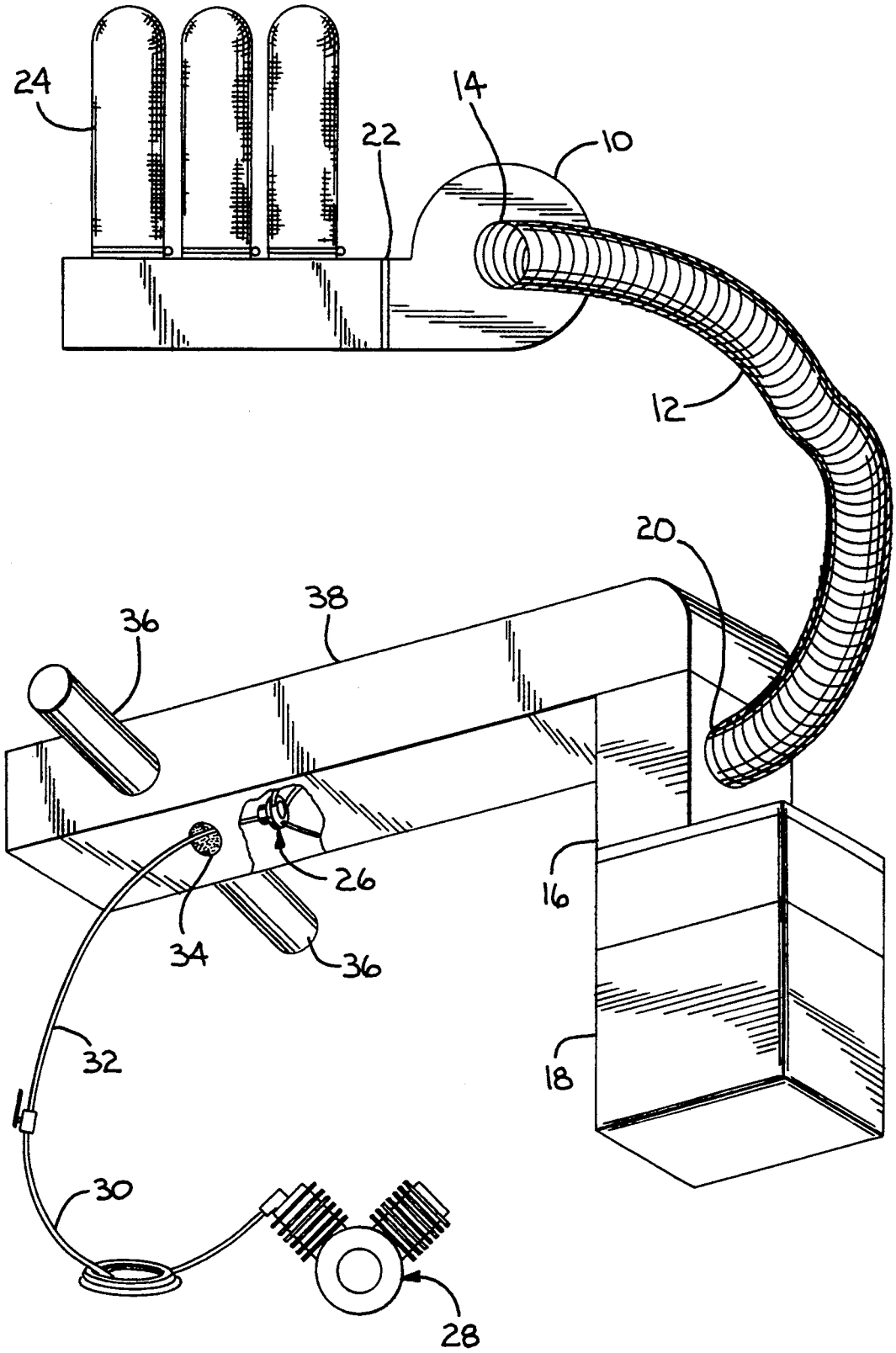
FIG. 1 is a schematic representation of a preferred form of cleaning system according to the present invention.

Referring to the drawings in detail and initially to FIG. 1, there is illustrated a commercial, paddle wheel suction fan 10 that provides a voluminous air flow in the duct system through a temporary duct 12, between the fan inlet 14 and the plenum 16 of a furnace/air-conditioner 18 at an opening 20 made by the cleaning crew for inducing a sufficiently large volume of air flow through the duct system to transport dust and detritus from the duct system into an enclosed dust collection chamber 22 thence through filter bags 24. The purpose of the bags 24 is to separate particulate matter from process air and to contain and collect the particulate matter in a dust collection chamber.

A cleaning head 26 requires high pressure air that is supplied by a remote air compressor 28 through a flexible, high pressure hose 30 delivering compressed air from said air compressor 28 to the cleaning head 26 through air conduit 32.

Access holes 34 (one shown) are judiciously cut into the plenum 16 to give maximum access to branch ducts 36 and the main duct 38 for introduction of the cleaning head 26, and the air conduit 32. In the cleaning process the cleaning head 26 is introduced into the branch ducts 36 access hole 34 and then into the various reaches of the main duct 38 starting with the duct sections more distant from the point of connection 20 of the remote suction fan 10, and working progressively through the duct system toward the plenum 16 until all interior duct surface have been cleaned.

Figure 2:
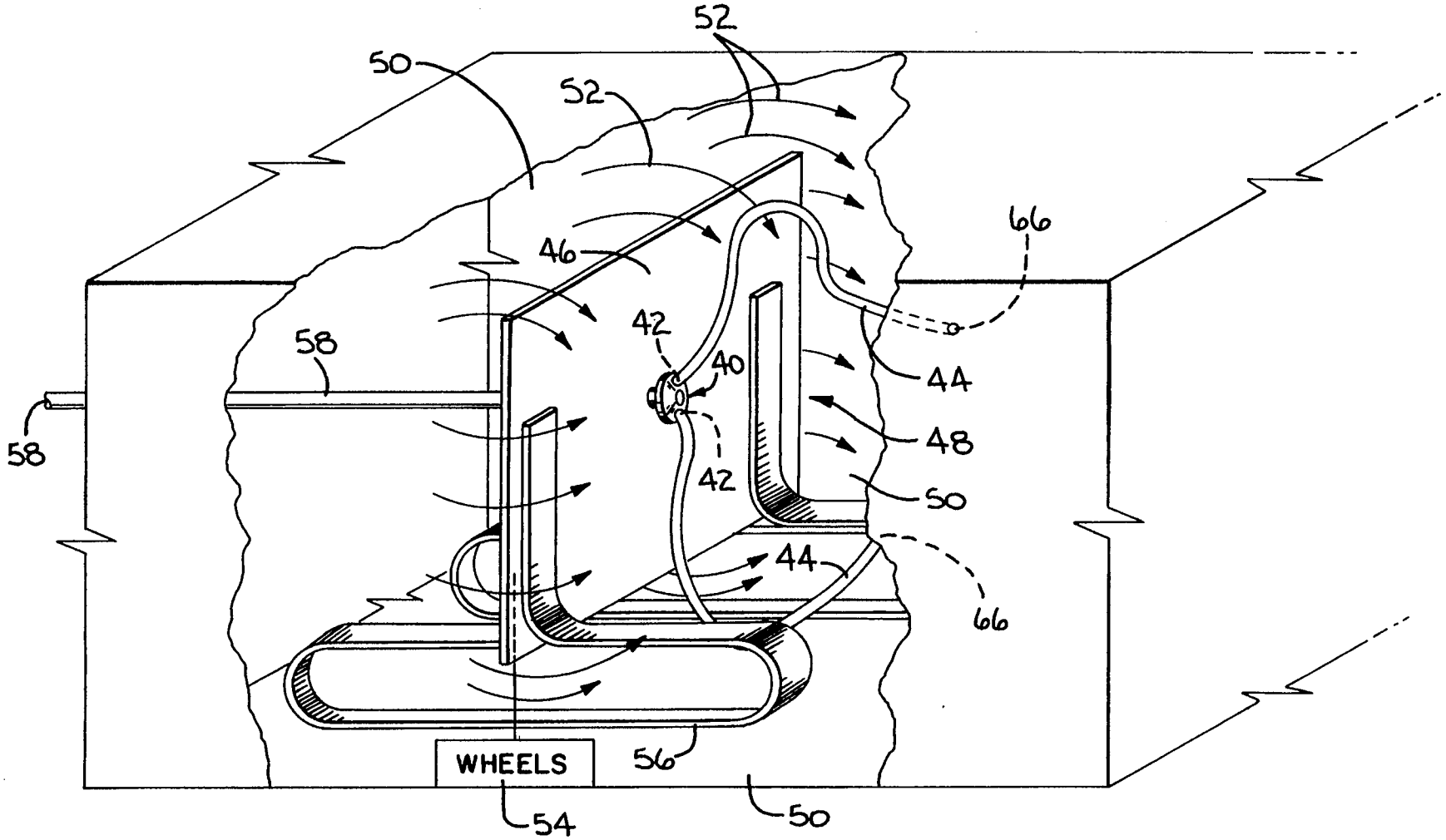
FIG. 2 is an enlarged, fragmentary, perspective view of a duct on the system in FIG. 1 showing a baffle and cleaning head according to the present invention.

FIG. 2 illustrates a preferred embodiment of the cleaning apparatus consisting of an air distributing manifold 40, to which are attached one or more barbs or suitable fitments 42 for securing flexible scouting element(s) 44. The air distribution manifold 40 is affixed to and removable from a baffle 46, a rigid plate and, by its position centrally in the duct, and at a 90 degree angle to the flow of air in the duct, it serves to interrupt plug flow of air through the center of the duct and to redirect this air flow from the center of the duct being cleaned, to the annular opening 48 between the baffle 46 and the interior duct surfaces 50 the air flow here depicted in FIG. 2 by arrows 52, the annular opening size to be by operator choice with air entrainment velocity for the detritus being removed from the duct as the velocity goal gained through selective choice of baffle size. The baffle 46 has a vertical dimension to extend preferably at least one half the vertical dimension of the duct space and a horizontal dimension to extend preferably at least one half of the horizontal dimension of the duct space. Increasing the velocity of the air flow locally in the duct in this manner provides the air entrainment velocity necessary to pick up, entrain and carry away dust and detritus from the duct surface. Further, the baffle 46 is mounted on wheels (shown schematically at 54), sloping surfaces or, in this instance, a suitable frame 56 that would help to position the baffle 46 in the duct and, by its shape, would tend to ride over obstructions in the duct such as duct seams.

The baffle 46 is positioned laterally along the duct run by a variable length of air conduit 58 rigidly fastened to the baffle 46. In another role, the air conduit 58 delivers air, under pressure, to scouring element(s) 44 attached directly to the air conduit 58 or to an intermediate manifold 40, said manifold 40 having affixed thereto fitments/barbs 42 for attaching one or more, and, in this preferred embodiment two hollow, flexible tubes or scouring elements 44. The scouring elements 44 are actuated by air under pressure flowing through the air conduit 58/manifold 40/barb 42 system. Compressed air discharging from the free ends 66 of the scouring elements 44 induces a reaction in said scouring elements 44, said air discharge causing a sinuous, beating, scrubbing action of said scouring elements 44 over the interior surfaces 50 of the duct that, in combination with the forceful discharge of air from the free ends 66 of said scouring elements 44 provides a novel, complex, energetic and efficient scouring action that breaks up and disperses loose or consolidated material on the interior duct surfaces, said material being easily entrained by the rapidly moving air induced by the suction fan 10, then carried by a temporary air duct 12 to a remote collection point as depicted in FIG. 1.

FIGS. 3 and 4 illustrate another embodiment of the invention, similar to that in FIG. 2, in which the aforesaid air conduit 58 is attached to an air manifold 68 that is attached, in turn, to a triangular baffle 70 that positions the manifold 68 in such a manner that, in the three-barb configuration illustrated, two fitments or barbs 72 to which a like number of hollow scouring elements 74 are attached, are always directed downward and outward toward the bottom of the duct where the largest deposits of dust and debris are usually found. Compressed air flowing through the air conduit 58, thence through the manifold 68, fitments 72 and the scouring elements 74 brings the maximum scouring effort to bear where the din and debris are heaviest, on the bottom surface of the duct.

FIG. 5 illustrates a cleaning head 76, in its simplest workable configuration, without a baffle, and consisting of, in this instance, an air conduit 58 for positional control and a means whereby compressed air is conveyed to the manifold 78. Said manifold 78 distributes the compressed air to barbs or fitments 80, thence through the hollow scouring elements 82 activating said scouring elements 82 in the work area. In this configuration the cleaning head 76 can be used for general cleaning operations and in close or confined quarters such as heat exchangers, fan elements, small ducts, etc. The cleaning head 76 is depicted in this embodiment with three scouring elements 82 but is not restricted thereto, since one, two, four or more of the said scouring elements 82 might be effectively used in some cleaning situations with the manifold 78 being unnecessary if only one scouring element is employed.

Figure 6:
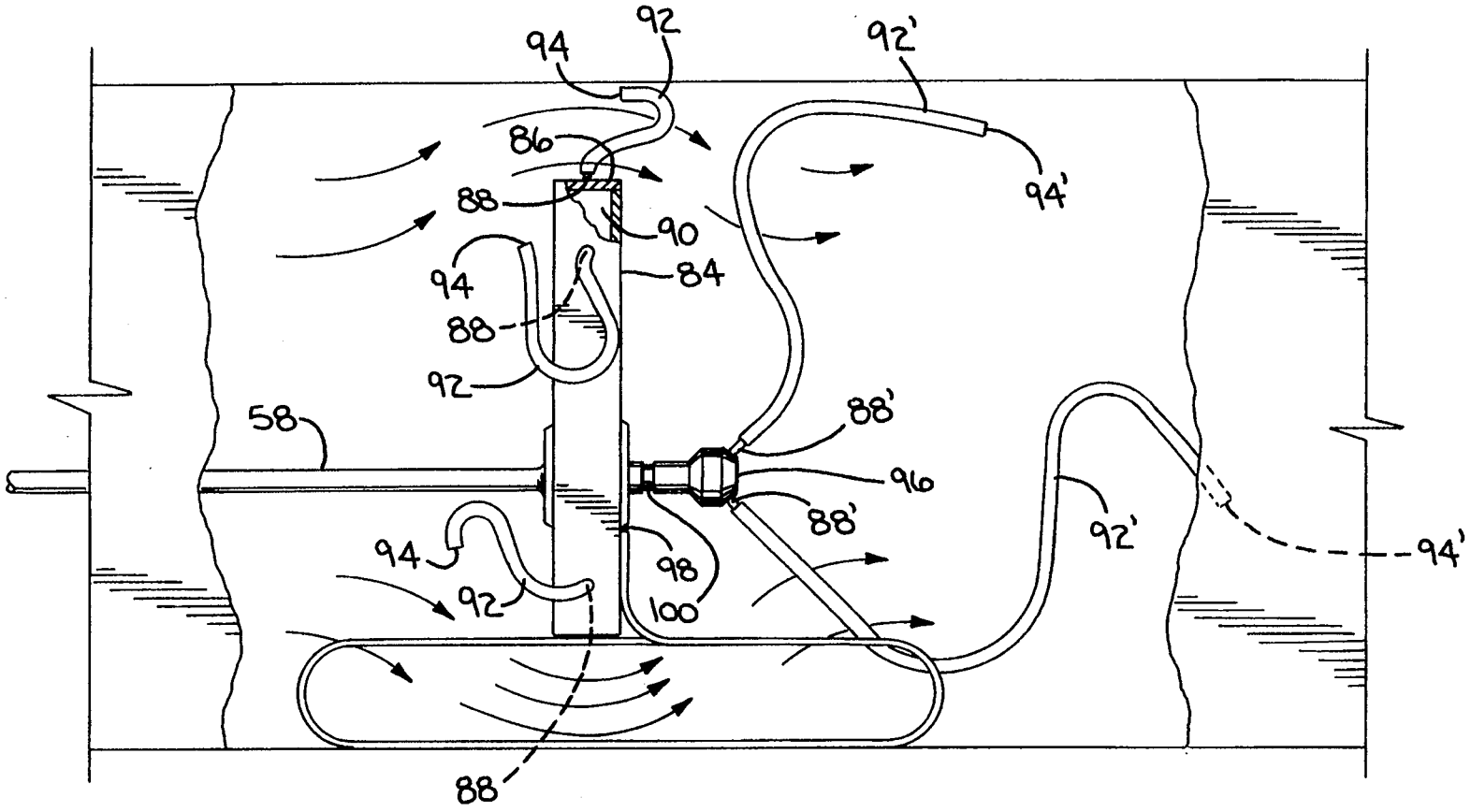
FIG. 6 is a side elevation view of a duct broken away to expose another form of baffle and cleaning head, according to the invention.

FIG. 6 illustrates another embodiment of the invention in which a baffle 84 serves the dual roles of baffle and air distribution manifold. In this configuration, compressed air flows through the air conduit 58 into the hollow baffle 84 with the baffle/manifold 84 acting in a dual role as an air distribution device and as a baffle, the baffle 84 being similar in function to the baffle 46 in FIG. 2 in that it redirects the normal plug flow of air through the duct to an annular area around the edges 86 of the baffle 84 in order that the air might achieve the velocities necessary to entrain detritus. In this embodiment fitments 88 are attached to the baffle 84 to lead compressed air from the hollow interior 90 of the baffle 84 to scouring elements 92 that are attached one each to a barb or fitment 88 with the free ends 94 allowed to move about in a rapid sinuous motion in response to the release of compressed air from the free ends 94 of the scouring element 92 thereby providing the energy for actuation of the scouring element(s) 92 in their role as a cleaning mechanism, the said barbs 88 being so disposed as to direct the action of their attached elements 92 generally, and directly, at the surfaces of the ducts to be cleaned adjacent to each scouring element 92.

In this embodiment scouring elements 92' could, in some situations, be effectively used directly in front of the baffle 84 to loosen detritus in the general area of the duct ahead of the baffle 84. To this end a small manifold 96 can be effectively employed attached to the forward face 98 of the baffle/manifold 84 on which barbs or fitments 88' are provided for securing additional scouring elements 92' with free ends 94'. The lateral position of the small manifold 96 can be altered relative to the hollow manifold 84, by lengthening, as might be required, a hollow, air conducting intermediate member 100 to give the scouring elements 92, 92' a clearer field for activity.

It will be apparent to those skilled in the art that although specific embodiments of the invention have been disclosed in order to illustrate the inventive concept, the invention is not limited thereto but rather includes all reasonable and obvious variations and modifications within the spirit and scope of the appended claims.

I claim:

1. In combination:

(a) a duct having an inside space bounded by a wall surface; and (b) a cleaning system for said wall surface, said cleaning system comprising:

a frame;

a first scouring conduit for delivering a pressurized fluid in said duct space and against the wall surface of the duct;

first means for mounting the scouring conduit to the frame so that at least a portion of the scouring conduit can contact the wall surface of the duct with the frame at least partially in the inside duct space; and second means for repetitively bringing the portion of the scouring conduit into and out of contact with the wall surface of the duct at high speed to dislodge foreign matter therefrom, wherein the scouring conduit has at least a portion that is flexible and the second means comprises a pressurized fluid directed through the scouring conduit which causes the scouring conduit to whip by bending at the flexible portion thereof.

2. The combination duct and cleaning system according to claim 1 wherein the first means mounts the scouring conduit so that pressurized fluid delivered by the scouring conduit impinges on the wall surface at other than a right angle to the wall surface.

3. The combination duct and cleaning system according to claim 1 wherein the duct has spaced upstream and downstream ends and the system includes means for drawing a fluid in said duct space from the upstream duct end to the downstream duct end.

4. The combination duct and cleaning system according to claim 1 wherein the cleaning system includes a second scouring conduit like the first scouring conduit mounted to the frame in the same manner as the first scouting conduit is mounted to the frame.

5. The combination duct and cleaning system according to claim 1 including means for guiding translatory movement of the frame over an obstruction within the duct space.

6. In combination:

(a) a duct having an inside space bounded by a wall surface; and (b) a cleaning system for said wall surface said cleaning system comprising:

a frame;

a first scouring conduit for delivering a pressurized fluid in said duct space and against the wall surface of the duct;

first means for mounting the scouring conduit to the frame so that at least a portion of the scouring conduit can contact the wall surface of the duct; and second means for repetitively bringing the portion of the scouring conduit into and out of contact with the wall surface of the duct to dislodge foreign matter therefrom, wherein the duct space has a vertical dimension and a horizontal dimension and a baffle therein that a) extends vertically at least one half of the vertical dimension of the duct space and b) extends horizontally at least one half of the horizontal dimension of the duct space.

7. The combination duct and cleaning system according to claim 6 wherein the baffle has a substantially uninterrupted flat surface that has a vertical dimension that extends at least one half of the vertical dimension of the duct space and a horizontal dimension that extends at least one half of the horizontal dimension of the duct space.

8. The combination duct and cleaning system according to claim 7 wherein the flat surface resides in a plane that is substantially perpendicular to the direction of flow of fluid through the duct space.

9. The combination duct and cleaning system according to claim 6 wherein the baffle defines a hollow space and the first scouring conduit is in communication with the hollow baffle space, there is a second scouring conduit in communication with the hollow baffle space and means are provided for communicating pressurized fluid from a supply to the hollow baffle space for delivery to and through the first and second scouring conduits.

10. The combination duct and cleaning system according to claim 9 wherein the baffle has a peripheral wall with a surface that faces the inside wall surface of the duct and one of the scouring conduits resides at least partially between the peripheral baffle wall surface and the duct wall surface.

11. The combination duct and cleaning system according to claim 10 wherein the baffle has upstream and downstream sides, there is an extension from one of the upstream and downstream sides of the baffle and one of the scouring conduits is attached to the baffle extension.

12. The combination duct and cleaning system according to claim 9 wherein the system includes means for moving the frame within the inside duct space, said moving means comprising a supply conduit for communicating pressurized fluid from a supply to the hollow baffle space.

13. The combination duct and cleaning system according to claim 12 wherein the duct space has a top and a bottom and spaced sides, the supply conduit is semi-rigid to allow the supply conduit to be pushed and pulled to move the frame within the duct space and to allow the supply conduit to flex as to enter restricted openings in the duct, said supply conduit being connected to the baffle at a location between the top and bottom and the spaced sides of the duct space.

14. The combination duct and cleaning system according to claim 12 wherein the supply conduit comprises discrete sections with cooperating means on the sections to allow a desired overall length for the supply conduit to be selected.

15. A cleaning system for an inside wall surface of a duct, said cleaning system comprising:

a frame;

a scouring conduit for delivering a pressurized fluid against the wall surface of the duct;

said scouring conduit having at least a portion thereof that is flexible and readily bendable;

first means for mounting the scouring conduit to the frame; and means for communicating fluid from a pressurized supply to and through the scouring conduit to thereby cause the scouring conduit to repetitively bend in a whipping action to thereby whip at high speeds against a wall surface of a duct in which the cleaning system resides so that pressurized fluid is caused to randomly impinge on a wall surface of a duct in which the cleaning system resides.

16. A method of cleaning a duct having an inside space bounded by an inside surface, said method comprising the steps of:

providing a frame within the inside duct space;

mounting a first flexible scouring conduit with a discharge end to the frame;

directing a pressurized fluid through the flexible scouring conduit and thereby a) causing pressurized fluid to be directed from the discharge end of the scouring conduit against the inside duct surface and b) causing the flexible scouring conduit to randomly whip at high speeds and thereby cause repetitive contact between the flexible scouring conduit and the inside duct surface to thereby dislodge foreign matter from the duct inside surface; and removing dislodged foreign matter and foreign matter entrained in fluid within the inside duct space to a collection point.

17. The method of cleaning a duct according to claim 16 wherein the duct has a length, the step of directing a pressurized fluid through the flexible scouring conduit comprises the step of directing the pressurized fluid lengthwise of the duct in a downstream direction, and the step of removing foreign matter comprises the step of developing a suction force tending to draw foreign matter in a downstream direction.

18. The method of cleaning a duct according to claim 16 wherein the duct has a length and including the step of moving the frame lengthwise of the duct to treat different portions of the duct inside surface.

19. The method of cleaning a duct according to claim 16 including the steps of providing a manifold and a second flexible scouring conduit and directing the pressurized fluid simultaneously through the first and second flexible scouring conduits.

* * * * *